United States Patent [19]

Ogarek et al.

[11] 4,371,090

[45] Feb. 1, 1983

[54] SECONDARY SEAL FOR FLOATING ROOF STORAGE TANK

[75] Inventors: Bernard C. Ogarek, Park Ridge; Milton W. Heisterberg, Flossmoor, both of Ill.

[73] Assignee: GATX Tank Erection Corporation, Chicago, Ill.

[21] Appl. No.: 203,795

[22] Filed: Nov. 3, 1980

[51] Int. Cl.[3] ..... B65D 88/46

[52] U.S. Cl. ..... 220/224; 220/222

[58] Field of Search ..... 220/216–227, 220/89 B; 361/215

[56] References Cited

U.S. PATENT DOCUMENTS

| | | | |
|---|---|---|---|
| 2,427,171 | 9/1947 | Wiggins . | |
| 2,536,019 | 1/1951 | Allen | 220/224 |
| 2,754,026 | 7/1956 | Wiggins . | |
| 2,802,591 | 8/1957 | Wiggins . | |
| 2,973,113 | 2/1961 | Fino | 220/224 |
| 3,043,468 | 7/1962 | Horner, Jr. . | |
| 3,125,346 | 3/1964 | Pultorak | 220/226 X |
| 3,307,733 | 3/1967 | De Bock . | |
| 4,004,708 | 1/1977 | Boyd | 220/226 X |
| 4,018,356 | 4/1977 | Szasz et al. | 220/220 |
| 4,130,217 | 12/1978 | Hills et al. | 220/226 |
| 4,138,032 | 2/1979 | McCabe | 220/224 |
| 4,154,359 | 5/1979 | Bissett | 220/222 |
| 4,257,837 | 3/1981 | Lucas | 220/216 X |
| 4,287,999 | 9/1981 | Heisterberg | 220/222 |

FOREIGN PATENT DOCUMENTS

| | | | |
|---|---|---|---|
| 929723 | 6/1963 | United Kingdom | 220/226 |
| 1018442 | 1/1966 | United Kingdom | 220/226 |

*Primary Examiner*—William Price
*Assistant Examiner*—Gary E. Elkins
*Attorney, Agent, or Firm*—Dithmar, Stotland, Stratman & Levy

[57] ABSTRACT

A floating roof storage tank having an upstanding tank shell for containing liquid to be stored and having therein a floating roof floating on the surface of the stored liquid, a primary seal interconnecting the floating roof and the tank shell, and an annular secondary seal extending between the floating roof and the tank shell providing a gas tight seal and weather shield for the primary seal, sealant is used at the inner end of the secondary seal mounted to the floating tank to ensure the gas tight connection thereat, and a tapered and rounded flexible free or outer end of the secondary seal ensures that irregularities in the tank shell do not permit vapors to escape; support structures maintain the secondary seal in its desired configuration and a variety of structures are disclosed for maintaining adjacent arcuate sections of the secondary seal in fixed and sealed relation.

7 Claims, 14 Drawing Figures

FIG. 3
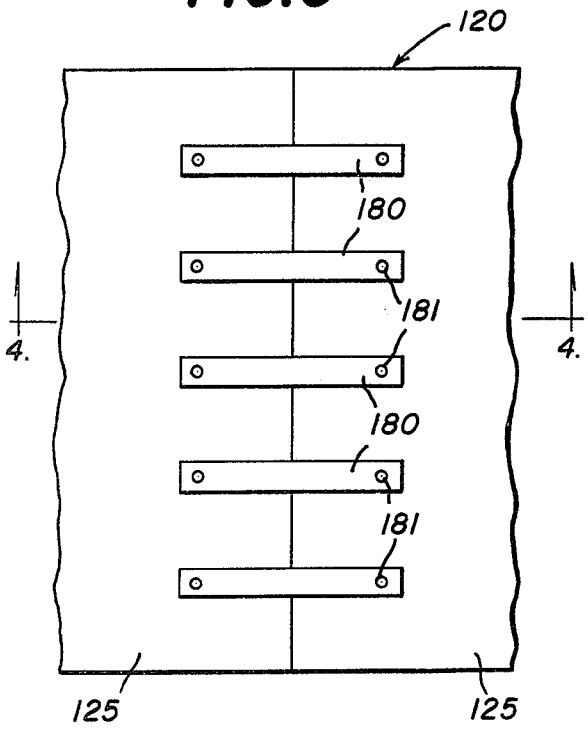
FIG. 5
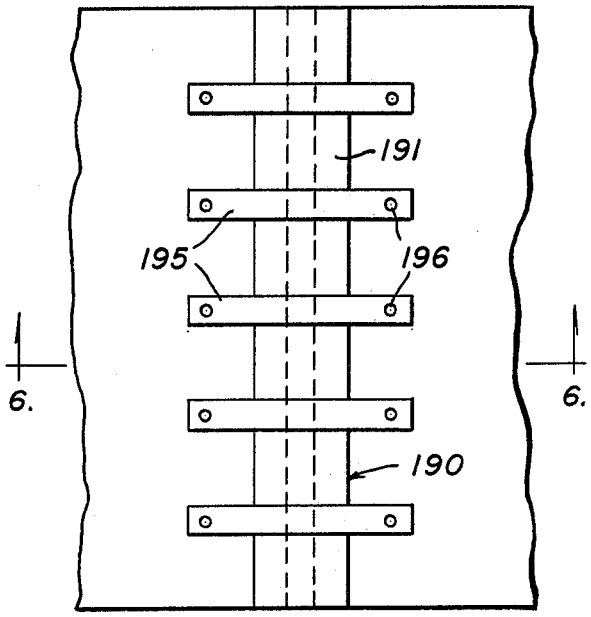
FIG. 4
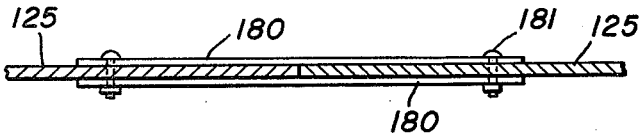
FIG. 6
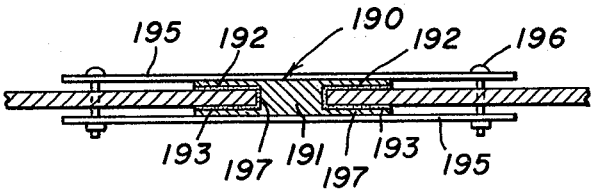
FIG. 7
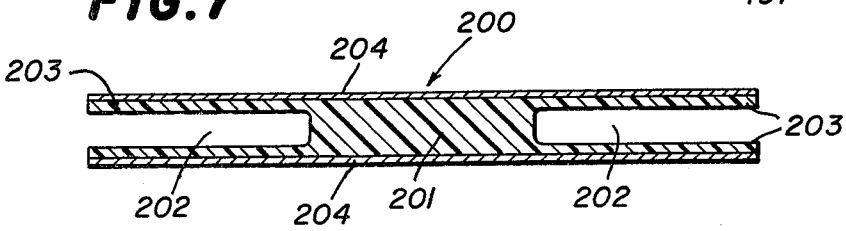
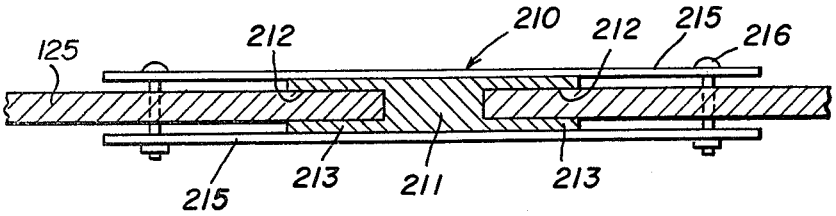
FIG. 8

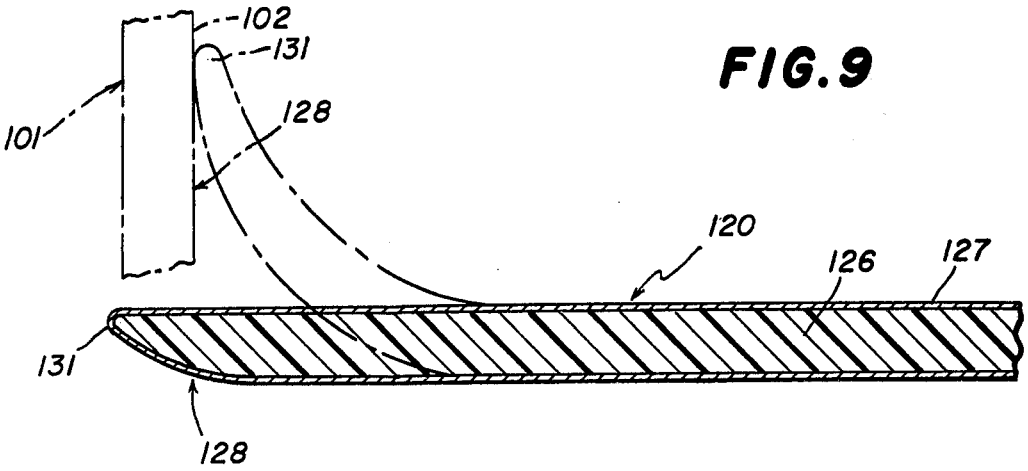
FIG. 9
FIG. 10
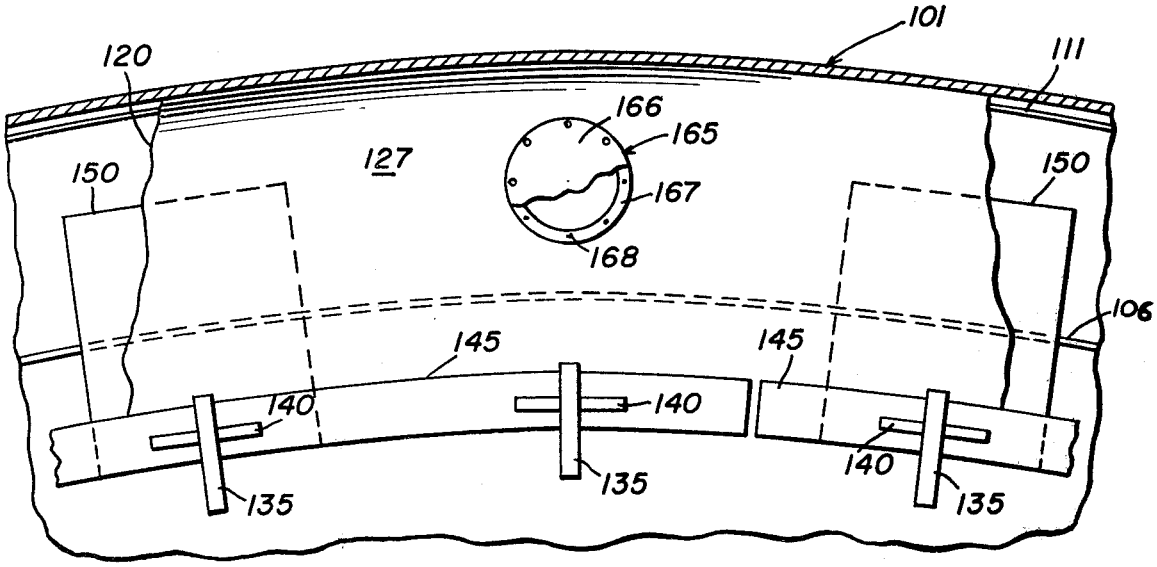
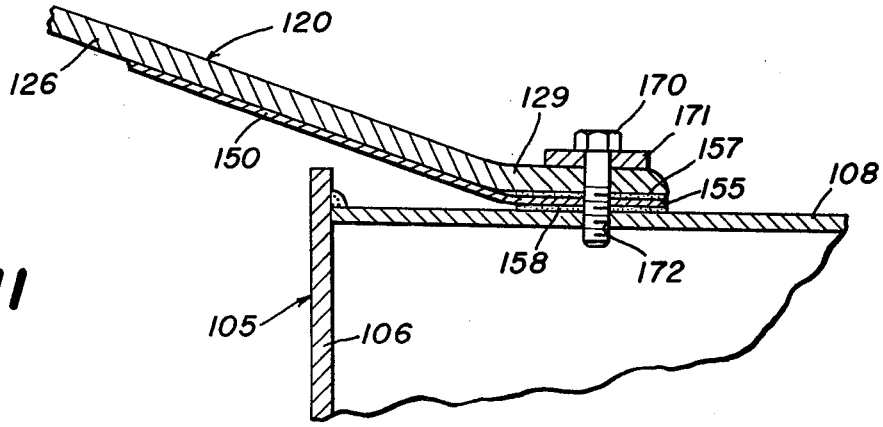
FIG. 11

FIG. 12
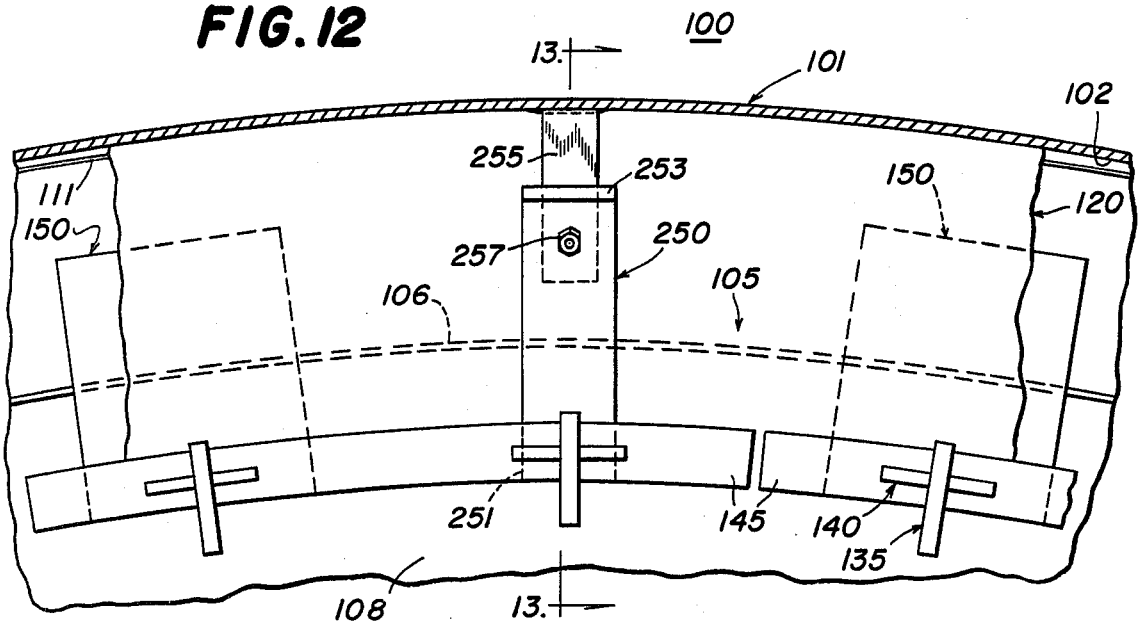
FIG. 13
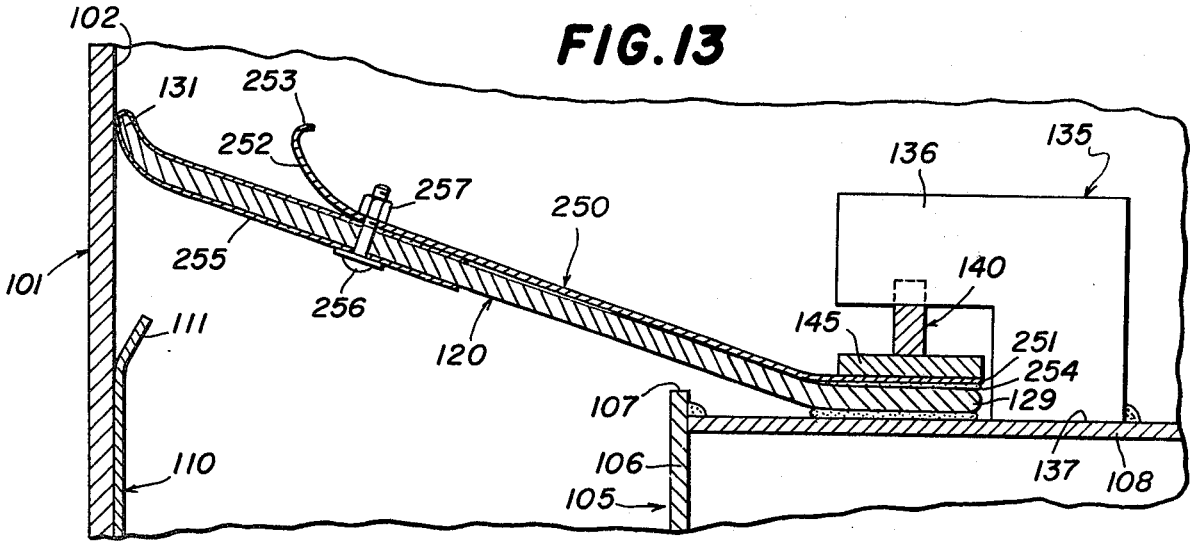
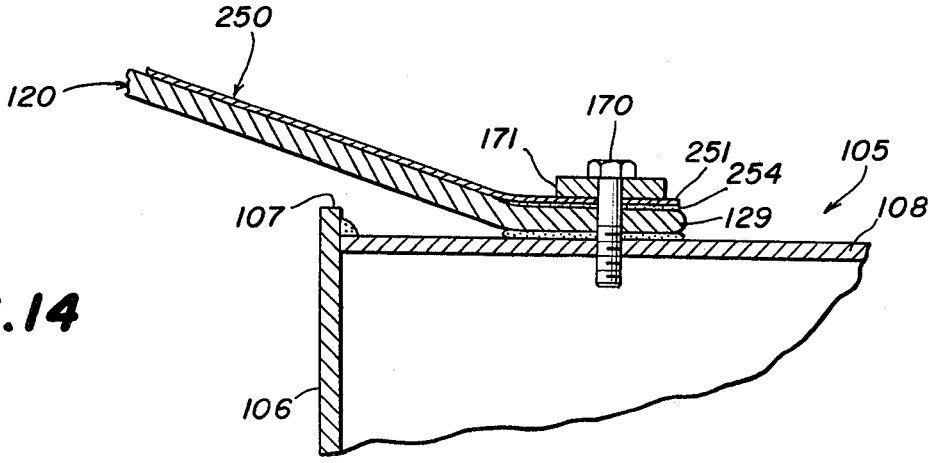
FIG. 14

SECONDARY SEAL FOR FLOATING ROOF STORAGE TANK

BACKGROUND OF THE INVENTION

The present invention relates to improvements in secondary seals for a floating roof storage tank, and specifically to the provision of a secondary seal that provides a gas tight additional seal between the tank shell and the floating roof rim.

Current air quality control regulations require that floating roof storage tanks be provided with both a primary seal and a secondary seal to control the emission of volatile components and fumes from liquid stored within the floating roof storage tank. The primary seal closes the opening between the floating roof rim and either the tank shell or a metal shoe sliding on the inner surface of the tank shell. The secondary seal closes the space between the tank shell and the floating roof rim above the primary seal. Examples of floating roof storage tanks in which the secondary seal of the present invention is useful are illustrated in U.S. Pat. No. 2,754,026 granted July 10, 1956 to J. H. Wiggins, U.S. Pat. No. 2,802,591 granted Aug. 13, 1957 to J. H. Wiggins, U.S. Pat. No. 3,043,468, issued July 10, 1962 to F. W. Horner, Jr. and U.S. Pat. No. 3,307,733, granted Mar. 7, 1967 to W. L. De Bock.

Secondary seals for floating roof storage tanks have been provided heretofore, and exemplars thereof are illustrated in U.S. Pat. No. 2,427,171 granted Sept. 9, 1947, to J. H. Wiggins and U.S. Pat. No. 4,154,359 granted May 15, 1979 to B. E. Bissett. The secondary seals illustrated in the foregoing patents do not teach gas tight connections to the floating roof and, indeed, the secondary seal of U.S. Pat. No. 2,427,171 is not even connected to the floating roof. While the secondary seal of the Bissett patent does close the space between the floating roof and the tank shell, it is inadequately supported and it makes no provision for access to the annular space between the primary and secondary seals. Furthermore, the upper edge of the Bissett secondary seal is susceptible to snagging on surface irregularities on the inside of the tank shell.

BRIEF SUMMARY OF THE INVENTION

The present invention provides a secondary seal for floating roof storage tanks which is gas tight with respect to the primary seal, and therefore, provides a separate and independent seal between the tank shell and the rim of the floating roof, functioning as both a vapor seal and a weather shield for the primary seal.

The secondary seal of the present invention is also constructed and arranged so as to provide access to the annular space between the primary and secondary seals for introduction of fire-extinguishing materials and the like.

In addition, the secondary seal, which may be constructed of plural sections for easy fabrication, is provided with gas tight means for joining adjacent sections.

Furthermore, the secondary seal is provided with support means for preventing sagging while holding the seal firmly against the tank shell.

These and other features are achieved in the present invention, and it is an object of the present invention to accomplish these desired results, by providing a floating roof storage tank comprising an upstanding cylindrical tank shell for containing a quantity of liquid to be stored, a floating roof within the tank shell adapted to float on the surface of the liquid within the tank shell, first sealing means extending between the floating roof and the tank shell and closing the space therebetween to provide a primary seal therebetween, a second sealing member secured to the floating roof and extending therebeyond and lying in sealing engagement with the inner surface of the tank shell to form a secondary seal between the floating roof and the tank shell, and a sealant providing a gas tight seal between the second sealing member and the floating roof.

Another object of the invention is to provide a floating roof storage tank of the type set forth wherein clamp means on the floating roof circumferentially spaced therearound secures the second sealing member to the floating roof, the clamp means including removable wedges for wedging the second sealing member toward the floating roof, and sealing means between the floating roof and the second sealing member providing a gas tight seal therebetween.

Yet another object of the invention is to provide a floating roof storage tank of the type set forth wherein the free end of the second sealing member is tapered and rounded to provide an enlarged bearing surface and to accommodate irregularities on the tank shell, the length of the second sealing member being sufficient to ensure the tapered and rounded end thereof being in contact with the inner surface of the tank shell to provide substantially a gas tight fit therebetween, and sealing means providing a gas tight seal between the second sealing member and the floating roof.

Still another object of the invention is to provide a floating roof storage tank of the type set forth wherein the sealing member is formed of plural sections, with gas tight means for joining adjacent sections to form an annular secondary seal between the floating roof and the tank shell.

A further object of the invention is to provide a floating roof storage tank comprising an upstanding cylindrical tank shell for containing a quantity of liquid to be stored, a floating roof within the tank shell adapted to float on the surface of the liquid within the tank shell, first sealing means extending between the floating roof and the tank shell and closing the space therebetween to provide a primary seal therebetween, a second sealing member secured to the floating roof and extending therebeyond and lying in sealing engagement with the inner surface of the tank shell to form a secondary seal between the floating roof and the tank shell, fusible means in the second sealing member permitting entry into the annular space between the primary seal and the secondary seal, and sealing means providing a gas tight seal between the second sealing member and the floating roof.

Further features of the invention pertain to the particular arrangement of the parts of the secondary seal for the floating roof storage tank, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 3 is a fragmentary plan view showing sealing structure for joining adjacent sections of the secondary seal;

FIG. 4 is a view in section of the sealing structure of FIG. 3 along line 4—4 thereof;

FIG. 5 is a fragmentary plan view of another embodiment of the sealing structure for joining adjacent sections of the secondary seal;

FIG. 6 is a view in section of the sealing structure of FIG. 5 along line 6—6 thereof;

FIG. 7 is a view in section of another embodiment of a fixture for joining adjacent sections of the secondary seal;

FIG. 8 is a view in section of another embodiment of a fixture for joining adjacent sections of the secondary seal;

FIG. 9 is a sectional view of the tapered and rounded free end of the secondary seal;

FIG. 10 is a view like FIG. 1 showing a fusible member in the secondary seal;

FIG. 11 is a view of another embodiment of means securing the secondary seal to the floating roof storage tank;

FIG. 12 is a view similar to FIG. 1, and illustrating another embodiment of the present invention which includes external support springs for the secondary seal;

FIG. 13 is an enlarged fragmentary view in vertical section taken along the line 13—13 in FIG. 12; and FIG. 14 is a fragmentary sectional view similar to FIG. 11 illustrating an alternate means of securing the external support springs to the floating roof.

DETAILED DESCRIPTION OF THE PREFERRED EMBODIMENTS

Figure 1:
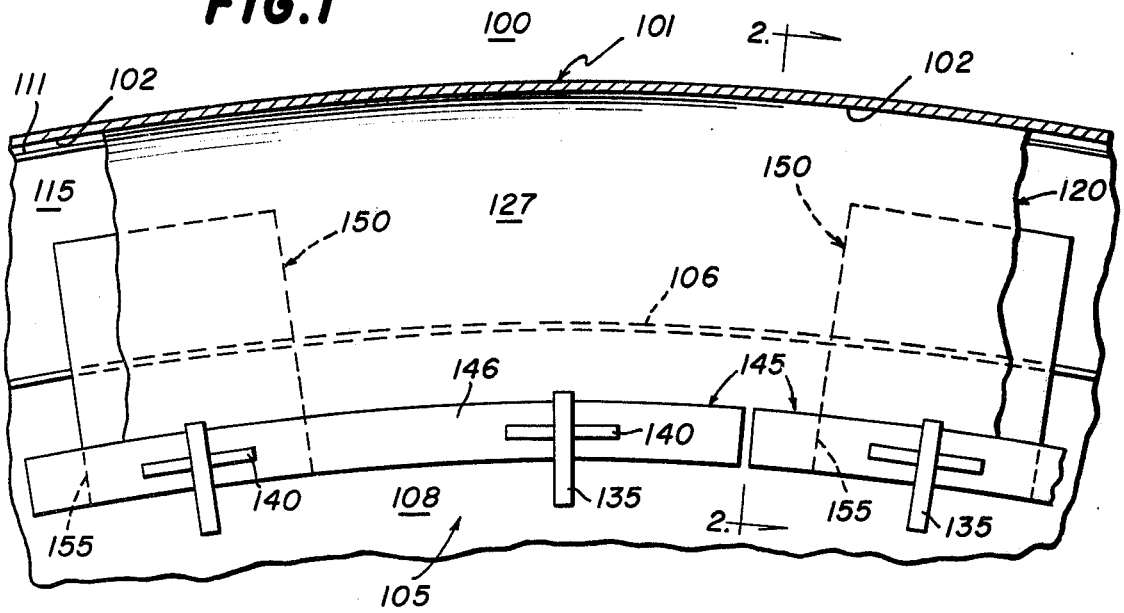
FIG. 1 is a fragmentary view in horizontal section of the tank shell illustrating a portion of the floating roof and incorporating therein a secondary seal made in accordance with and embodying the principles of the present invention.
Figure 2:
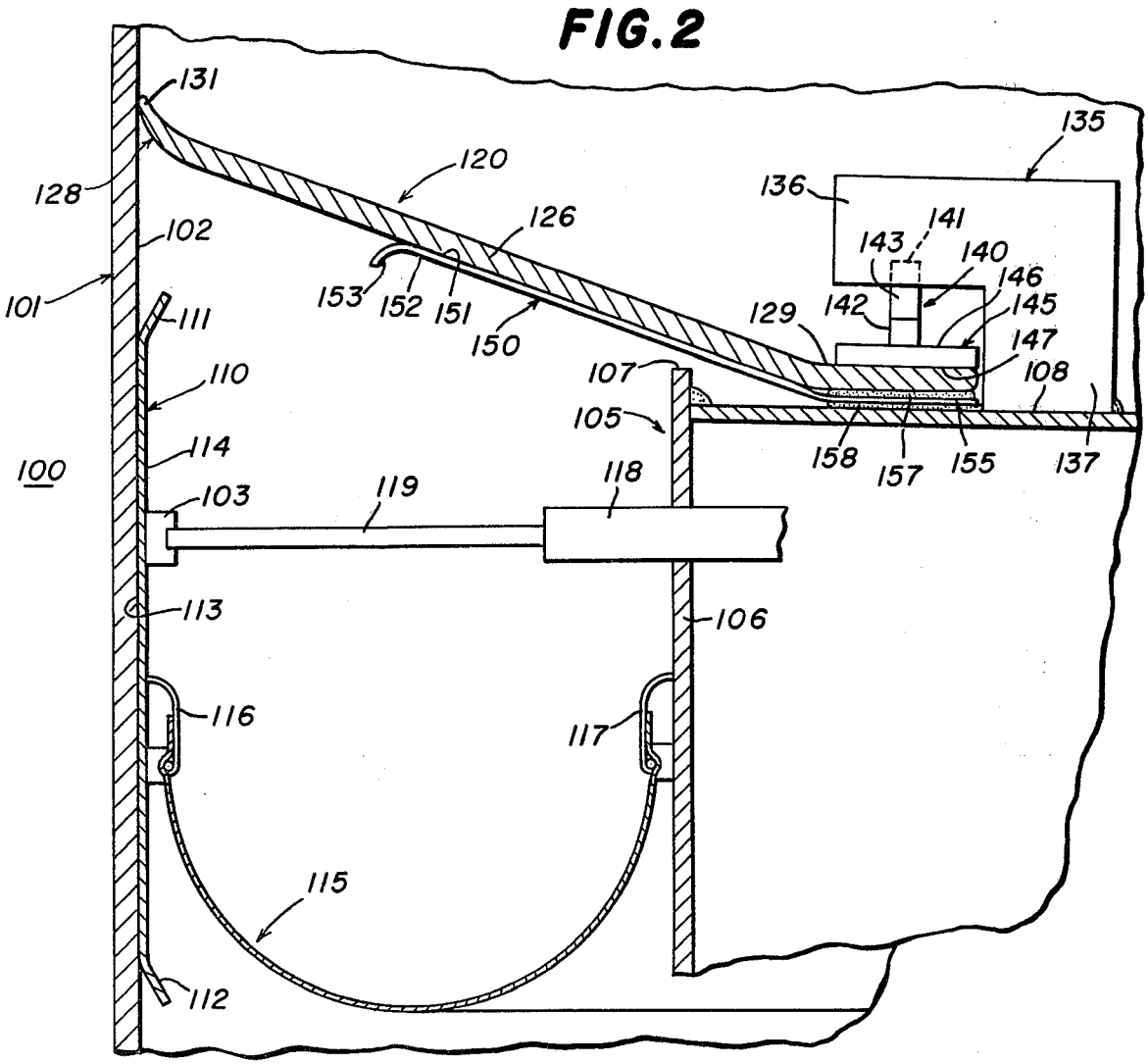
FIG. 2 is a fragmentary view in vertical section showing the construction of the primary seal and the secondary seal along the line 2—2 of FIG. 1.

Referring to FIGS. 1, 2 and 9 of the drawings, there is illustrated a floating roof storage tank 100 incorporating therein a primary seal 115 and a secondary seal 120, the secondary seal being made in accordance with and embodying the principles of the present invention.

The floating roof storage tank 100 includes the usual upright cylindrical tank shell 101 that is circular in horizontal cross section and has an inner surface 102 against which the liquid stored is in contact. Such storage tanks are widely used to hold petroleum and petroleum products, such as gasoline, as well as other volatile liquids. Disposed within the tank shell 101 and spaced radially inwardly from the inner surface 102 thereof and adapted to float on the surface of the liquid within the tank shell 101 is a floating roof or pontoon 105. The floating roof 105 is a hollow structure having an outer wall or rim 106 with an upper edge 107, the wall 106 being circular in horizontal section and being spaced away from the tank shell 101.

The bottom of the outer wall 106 is closed by a bottom wall (not shown) and a top wall or cover plate 108 closes the top of the outer wall 106. The tank shell 101 and the floating roof 105 are normally made of metal, such as steel.

The primary sealing system for the storage tank 100 may be a metal shoe-type, as exemplified by the Wiggins U.S. Pat. No. 2,802,591, or a soft, toroidal, filled-envelope-type, as disclosed in the DeBock U.S. Pat. No. 3,307,733. For purposes of illustration, only the metal shoe-type is depicted in the drawings. More particularly, a metal shoe 110 is disposed within the tank shell 101 and slidably engages the inner surface 102 of the tank shell 101. The upper edge of the metal shoe 110 has an inwardly and upwardly directed upper flange 111 extending therearound, and the lower edge of the metal shoe 110 has an inwardly and downwardly directed lower flange 112 extending therearound. The metal shoe 110 has an outer surface 113 that bears against the inner surface 102 of the tank shell 101, and also has an inner surface 114.

The primary seal 115 is provided between the floating roof 105 and the metal shoe 110 in the form of a flexible sealing member which has the outer edge thereof secured by clamps 116 to the inner surface 114 of the metal shoe 110 and has the inner edge thereof secured by clamps 117 to the outer surface of the floating roof wall 106. The metal shoe 110 is carried by and moves upwardly and downwardly with the floating roof 105, pusher structures (one shown) being provided interconnecting the floating roof 105 and the metal shoe 110 and including a piston cylinder 118 mounted on the floating roof 105 and a piston rod 119 extending therefrom and secured by a bracket 103 to the inner surface 114 of the metal shoe 110. Details of the construction and operation of the pusher structures are set forth in U.S. Pat. No. 2,802,591 referred to above.

Referring also to FIGS. 3 and 4 of the drawings, the secondary seal 120 comprises an annular flexible sheet which may be formed of a plurality of discrete sections 125. Each of the sections 125 of the secondary seal 120 includes an elastomeric body portion 126 encapsulated in a synthetic organic resin cloth outer covering 127 and has a free or outer end 128 which is tapered as at 131 with a rounded end to provide a flexible wiper for contacting the adjacent surface 102 of the tank shell 101, thereby providing a weather shield (see FIG. 9). The inner or attachment end 129 of each of the sections 125 is maintained in fixed relation to cover plate 108 of the floating roof or pontoon 105 by means of a plurality of circumferentially spaced clamp lugs 135, each of the clamp lugs 135 having a horizontal portion 136 and a vertical or support portion 137. There is also provided retaining means including a plurality of wedges 140, each associated with a corresponding one of the clamp lugs 135, each wedge 140 having a larger end 141, a smaller end 142 and a ramp surface 143 interconnecting the two ends.

An arcuate clamp bar 145 or pressure transmitting member is associated with at least two adjacent clamp lugs 135, the clamp bar 145 having sufficient arcuate extent to extend beyond two adjacent clamp lugs 135 and to transmit sealing pressure from the lugs due to the wedges 140 to the portion of the seal 120 adjacent thereto. Each of the arcuate clamp bars 145 has an upper surface 146 contacted by the associated wedge 140 and a lower surface 147 in contact with the attachment or inner end 129 of the associated section 125 of the secondary seal 120, thereby to maintain each section 125 in place and connected to the floating roof or pontoon 105. An advantage of the clamp lugs 135, the wedges 140 and the clamp bar 145 is that no openings are required to be made through the sections 125.

A plurality of anti-sag supports 150 are circumferentially spaced around the floating roof 105 and serve to support each of the sections 125 forming the secondary seal 120, each of the anti-sag supports 150 having an upper surface 151 in contact with the associated section 125 and a lower surface 152. Each anti-sag support 150 has at the outer or free end thereof a downturned flange 153 to prevent inadvertent sagging of the secondary seal 120 and an inner or clamping end thereof 155 which is fixedly maintained in place by means of the cooperation of the associated clamp lug 135 and wedge 140. As illustrated in FIGS. 1 and 10 of the drawings, an anti-sag support 150 is associated with alternate ones of the clamp lugs 135.

In order to provide a gas tight seal between the floating roof or pontoon 105 and the secondary seal 120, it is necessary to insure the gas tight nature of the seal at each end thereof. To this end, there is provided sealant material 157 between the inner or attachment ends 155 of the associated anti-sag supports 150 and the attachment end 129 of the secondary seal 120, and sealant material 158 is provided between the inner or attachment ends 155 of the anti-sag supports 150 and the associated cover plate 108 of the floating roof or pontoon 105. The associated clamp lug 135 and wedge 140 maintain the secondary seal 120 as well as the anti-sag supports 150 in an upwardly and outwardly extending position illustrated in the drawings to maintain the gas tight nature of the secondary seal 120. The sealant material 157 and 158, as will be appreciated by those skilled in the art, may be made of any suitable air curing adhesive material which is substantially unaffected by the lading usually stored within the floating roof storage tank 100.

Fusible members 165 (one shown, see FIG. 10) are positioned at circumferentially spaced apart locations along the secondary seal 120 to permit ready access to the annular space between the secondary seal 120 and the primary seal 115 for introduction of fire-fighting foam or the like in the event of a rim fire. The fusible members 165 may be of any suitable low melting point synthetic organic resin such as a low melting point polyethylene, each of the fusible members being in the form of a disc 166 supported by a clamp ring 167 suitably connected to the associated secondary seal section 125 by a plurality of fasteners 168 circumferentially positioned around the ring 167.

Referring now to FIG. 11 of the drawings, there is shown an alternate mechanism for attaching the secondary seal 120 to the associated floating roof or pontoon 105 and particularly the cover plate 108 thereof. A plurality of fasteners 170, each having an expanded head or washer portion 171, are circumferentially spaced about the inner or attachment ends 129 and 155, respectively, of the secondary seal 120 and the associated anti-sag supports 150. The presence of the sealant material 157 and 158 on both sides of the anti-sag supports 150, where said supports are present along the circumferential extent of the secondary seal 120, and the presence of multiple layers of sealant material where the anti-sag supports 150 are not present ensure a gas tight seal even though the fasteners 170 extend through the secondary seal 120 and the associated cover plate 108.

Referring now to FIGS. 3–8 of the drawings, there are disclosed various mechanisms for maintaining the edges of adjacent sections 125 in sealing relation, thereby to form the secondary seal 120 and preserve the gas tight nature thereof. FIGS. 3 and 4 particularly show a plurality of radially spaced apart and circumferentially-extending strips 180 placed in registry on the upper and lower sides of adjacent sections 125 forming the secondary seal 120, and spanning the junction therebetween. Each of the strips 180 is provided with fasteners 181 near the ends thereof, each fastener 181 extending through one of the adjacent sections 125, thereby to maintain the adjacent sections 125 in fixed and abutting relation.

FIGS. 5 and 6 disclose a radially-extending fixture 190 which includes a body portion 191 which may be of the same elastomeric material as the body portion 126 of the secondary seal 120, the fixture 190 including oppositely extending slots 192 formed by associated leg portions 193 extending outwardly from the body portion 191, circumferentially of the secondary seal 120. A plurality of radially spaced-apart circumferentially-extending strips 195 placed in registry above and beneath the fixture 190 extend outwardly beyond the slots 192 and the legs 193 of the fixture 190, each of the strips 195 overlying a portion of the adjacent sections 125 spaced from the radially extending end thereof. Suitable fasteners 196 extend through the two strips 195 near the ends thereof to maintain the adjacent sections 125 with the radial edges thereof respectively in the slots 192 of the body portion 191 and fully seated therein. Sealant material 197, which may be of the same character as the sealant material 157 and 158 previously discussed, may be positioned within each of the slots 192 to ensure the gas tight nature of the secondary seal 120.

FIG. 7 illustrates a radial fixture 200 which includes a body portion 201 which may be made from the same elastomeric material as the sections 125 forming the secondary seal 120, the body portion 201 having outwardly extending spaced apart leg portions 203 each defining an oppositely extending slot 202. The fixture 200 is further provided with coverings 204 which may be of the same synthetic organic resin as the covering 127 for the secondary seal 120, the covering being a suitable weather-resistant material. Operation of the fixture 200 is the same as the previously discussed fixture 190 with the exception that the slots 202 are so dimensioned as to frictionally receive and retain therein the associated radially extending edges of adjacent sections 125, whereby fasteners are unnecessary.

Fixture 210 in FIG. 8 is comprised of a body portion 211 which may be made of the same elastomeric material as the body portion 126 of the secondary seal 120 and has outwardly extending legs 213 each defining an appropriate oppositely extending slot 212 dimensioned frictionally to receive and retain therein the radially extending edge of the adjacent section 125. The fixture 210 includes a plurality of radially spaced apart strips 215 positioned in registry on opposite sides of the body portion 211, the strips 215 being provided with appropriate fasteners 216 extending therethrough and through the associated one of the adjacent sections 125. The fixture 210 is similar to the fixture 190 with the exception of the sealant material which is not present in the fixture 210.

Referring now to FIGS. 12 and 13 of the drawings, there is illustrated an alternative embodiment of the present invention which is similar to that disclosed in FIGS. 1, 2 and 9, but which additionally includes a plurality of external support springs (one shown), generally designated by the numeral 250, for providing additional support for the secondary seal 120. Preferably, the external support springs 250 are equidistantly spaced around the secondary seal 120. with each external support spring 250 being disposed substantially midway between adjacent ones of the anti-sag supports 150.

Each of the support springs 250 is formed of a relatively thin, substantially flat rectangular strip of metal bent at one end thereof to form an attachment end 251, and bent at the other end thereof to form a curved distal end 252 provided with a hook-like lip 253 at the tip thereof. In assembly, the support spring 250 overlies the secondary seal 120, with the attachment end 251 thereof overlying the attachment end 129 of the secondary seal 120 beneath the associated clamp bar 145. Preferably, a sealant material 254 is disposed between the attachment end 251 of the support spring 250 and the attachment end 129 of the secondary seal 120. The entire assembly being firmly clamped in place by the associated wedges 140, as described above.

There is preferably also provided an elongated metallic ground strap 255, one end of which is disposed between the secondary seal 120 and the external support spring 250 adjacent to the distal end 252 thereof. The ground strap 255 extends radially outwardly along the top of the secondary seal 120 to the peripheral edge thereof, around the edge and back radially inwardly along the underside of the secondary seal 120, the overlapping ends of the ground strap 255 being fixedly secured to the support spring 250 and the secondary seal 120 by a bolt 256 and associated nut 257. It will be appreciated that the ground strap 255 is disposed in electrical contact with the tank shell 101 for providing a grounding connection thereto.

Referring to FIG. 14 of the drawings, there is illustrated an alternative means of attachment of the external support springs 250 to the floating roof 105 by means of the threaded fasteners 170, in the same manner as was described above in connection with FIG. 11. Sealant material 254 is disposed between the attachment portion 129 of the secondary seal 120 and the attachment portion 251 of the support spring 250 in this attachment arrangement also.

In general, the important features of the present invention are the gas tight nature of the secondary seal 120. This is accomplished by the sealant between adjacent members at the floating roof 105, by the gas-tight joinder of abutting edges of adjacent sections 125, by the tapered and rounded end 131 of the outer or free end of the seal 120 which provides a wiper resiliently positioned against the inner surface 102 of the tank shell 101 and continually urged against said surface by the effective length of the seal 120 and the external support springs 250. The tapered and rounded edge 131 conforms to any tank shell irregularities, thereby eliminating gaps from which vapors from the lading may escape. The secondary seal 120 with the tapered and rounded edge 131 thereof acts as a weather shield protecting the primary seal 115 from the environment, thereby preventing rain and other airborne debris from contacting the primary seal 115 and damaging same.

The secondary seal 120 may be made of a Buna-N-vinyl elastomer or similar synthetic organic resin having the requisite chemical resistance and preferably a durometer hardness in the range of between about 55 and 65. The reinforcing or covering 127 is preferably a nylon or a polyester cloth. The sealants 157 and 158 at the inner attachment end of the secondary seal 120 as well as the sealant 197 in the fixture 190 may be any suitable air curing adhesive or sealant. The same sealant may be used with the attachment means 170, which are self-tapping bolts, to ensure the gas tight nature of the connection between the secondary seal 120 and the floating roof or pontoon 105.

It is to be understood that the constructions illustrated in FIGS. 3 through 8 and FIGS. 10 through 14 of the drawings possess all the fundamental desirable characteristics and properties illustrated and described above with respect to FIGS. 1, 2 and 9 of the drawings.

While there have been described what at present are considered to be the preferred embodiments of the invention, it will be understood that various modifications and alterations may be made therein, and it is intended to cover in the claims appended hereto all such modifications and alterations as fall within the true scope of the present invention.

What is claimed is:

1. A floating roof storage tank comprising an upstanding cylindrical tank shell for containing a quantity of liquid to be stored, a floating roof within said tank shell adapted to float on the surface of the liquid within said tank shell, first sealing means extending between said floating roof and said tank shell and closing the space therebetween to provide a primary seal therebetween, a second sealing member secured to said floating roof and extending therebeyond and lying in sealing engagement with the inner surface of said tank shell to form a secondary seal between said floating roof and said tank shell, clamp means on said floating roof circumferentially spaced therearound for securing said second sealing member to said floating roof, said clamp means including removable wedges for wedging said second sealing member toward said floating roof, a sealant between said floating roof and said second sealing member providing a gas tight seal therebetween, and a plurality of fusible members in said second sealing member circumferentially spaced thereabout.

2. A floating roof storage tank comprising an upstanding cylindrical tank shell for containing a quantity of liquid to be stored, a floating roof within said tank shell adapted to float on the surface of the liquid within said tank shell, first sealing means extending between said floating roof and said tank shell and closing the space therebetween to provide a primary seal therebetween, an annular second sealing means secured to said floating roof and extending radially outwardly therefrom and lying in sealing engagement with the inner surface of said tank shell, said second sealing means including a plurality of arcuate sections with adjacent ones thereof having the free radial edges thereof abutting, bridging means including radially spaced-apart strips bridging said abutting radially extending edges and maintaining same in abutting relationship and fasteners extending through said strips and said adjacent arcuate sections for sealingly interconnecting same to form an annular secondary seal between said floating roof and said tank shell, and a sealant providing a gas tight seal between said annular secondary seal and said floating roof.

3. A floating roof storage tank comprising an upstanding cylindrical tank shell for containing a quantity of liquid to be stored, a floating roof within said tank shell adapted to float on the surface of the liquid within said tank shell, first sealing means extending between said floating roof and said tank shell and closing the space therebetween to provide a primary seal therebetween, an annular second sealing means secured to said floating roof and extending radially outwardly therefrom and lying in sealing engagement with the inner surface of said tank shell, said second sealing means including a plurality of arcuate sections, a fixture having oppositely extending slots dimensioned to receive the free radially extending edges of adjacent sections for sealingly interconnecting adjacent arcuate sections to form an annular secondary seal between said floating roof and said tank shell, said fixture having plate means overlying adjacent sections and means maintaining said fixture and said sections and said plate means in fixed relation, and a sealant providing a gas tight seal between said annular secondary seal and said floating roof.

4. A floating roof storage tank comprising an upstanding cylindrical tank shell for containing a quantity of liquid to be stored, a floating roof within said tank shell adapted to float on the surface of the liquid within said tank shell, first sealing means extending between said floating roof and said tank shell and closing the space therebetween to provide a primary seal therebetween, a second sealing member secured to said floating roof extending therebeyond and lying in sealing engagement with the inner surface of said tank shell to form a secondary seal between said floating roof and said tank shell, fusible means in said second sealing member permitting access to the annular space between said primary seal and said secondary seal, and a sealant providing a gas tight seal between said flexible secondary seal means and said floating roof.

5. The floating roof storage tank of claim 4, wherein said fusible means is low melting point polyethylene.

6. The floating roof storage tank of claim 4, wherein said fusible means includes a circular frame in said second sealing member and a fusible disc mounted on said frame and secured thereto.

7. The floating roof storage tank of claim 4, wherein said second sealing member includes a plurality of arcuate sections, and means sealingly interconnecting adjacent arcuate sections to form an annular secondary seal between said floating roof and said tank shell.

* * * * *